US006743001B2

(12) United States Patent
Iwanari et al.

(10) Patent No.: US 6,743,001 B2
(45) Date of Patent: Jun. 1, 2004

(54) FUEL PUMP HAVING ROTATABLY SUPPORTED PIPE MEMBER BETWEEN BEARING MEMBERS AND FIXED CENTER SHAFT

(75) Inventors: Eiji Iwanari, Chiryu (JP); Hiromi Sakai, Nukata-gun (JP)

(73) Assignee: Denso Corporation (JP)

( * ) Notice: Subject to any disclaimer, the term of this patent is extended or adjusted under 35 U.S.C. 154(b) by 28 days.

(21) Appl. No.: 10/201,319

(22) Filed: Jul. 24, 2002

(65) Prior Publication Data

US 2003/0026717 A1 Feb. 6, 2003

(30) Foreign Application Priority Data

Jul. 31, 2001 (JP) ..... 2001-232390
Apr. 25, 2002 (JP) ..... 2002-123317

(51) Int. Cl.[7] ..... F04B 17/03

(52) U.S. Cl. ..... 417/423.7; 417/423.12; 417/423.14; 415/229; 415/55.1; 316/87; 316/90; 316/261; 384/276; 384/295; 384/275

(58) Field of Search ..... 417/423.7, 423.12, 417/423.14; 415/229, 55.1, 55.2, 55.3, 55.4, 55.5; 310/90, 87, 62, 63; 384/261, 276, 295, 275

(56) References Cited

U.S. PATENT DOCUMENTS 3,604,962 A * 9/1971 Larson et al. ..... 310/67 R
3,836,291 A * 9/1974 Bottcher et al. ..... 415/55.1
4,134,712 A * 1/1979 Kemmner et al. ..... 417/423.12
4,878,767 A * 11/1989 Halder ..... 384/140
5,173,037 A * 12/1992 Martin et al. ..... 417/423.3
5,230,275 A * 7/1993 Hodge et al. ..... 92/68
5,388,971 A * 2/1995 Kobayashi et al. .... 417/423.14
5,601,370 A * 2/1997 Shibayama et al. ..... 384/215
5,620,261 A * 4/1997 Salz ..... 384/276
5,639,227 A * 6/1997 Mills ..... 417/423.11
6,012,898 A * 1/2000 Nakamura et al. ..... 415/107
6,019,570 A * 2/2000 Talaski ..... 415/55.1
6,123,103 A * 9/2000 Smith, III ..... 137/614.04
6,250,897 B1 * 6/2001 Thompson et al. ..... 417/407
6,420,809 B1 * 7/2002 Obara ..... 310/90

FOREIGN PATENT DOCUMENTS

GB 2346266 A * 2/2000
JP U-63-82086 5/1988
JP A-4-265689 9/1992

* cited by examiner

*Primary Examiner*—Justine R. Yu
*Assistant Examiner*—Emmanuel Sayoc
(74) *Attorney, Agent, or Firm*—Nixon & Vanderhye PC

(57) ABSTRACT

A pipe member is pushed into an inner periphery of a core of an armature to fix the pipe member to the armature. The pipe member is inserted over a fixed shaft. Bearing members have a small hole and a large hole formed at their centers. Pipe member ends are pushed into and fixed to the large diameter holes. The fixed shaft is inserted into the small holes to rotatably support the armature. A guide hole is formed at the center of an impeller of a pump unit, and is fitted to the bearing member, thereby the impeller rotates while the impeller is guided by the outer peripheral surface of the bearing member which rotates integrally with the armature. Coupling protrusions formed on the armature are inserted, and engaged with engagement recesses formed in the impeller to transmit a rotation force of the armature to the impeller.

7 Claims, 4 Drawing Sheets

FUEL PUMP HAVING ROTATABLY SUPPORTED PIPE MEMBER BETWEEN BEARING MEMBERS AND FIXED CENTER SHAFT

CROSS REFERENCE TO RELATED APPLICATIONS

This application is based upon, claims the benefit of priority of, and incorporates by reference, the contents of Japanese Patent Applications No. 2001-232390 filed Jul. 31, 2001, and No. 2002-123317 filed Apr. 25, 2002.

BACKGROUND OF THE INVENTION

1. Field of the Invention

The present invention relates to a fuel pump constructed such that a fixed shaft is at the center of a housing, and a motor unit and a pump unit rotate about the fixed shaft.

2. Description of Related Art

Japanese Patent Laid-Open Publication No. Sho. 63-82086 discloses a fuel pump. Generally, in this fuel pump, as shown in FIG. 4, a fixed shaft 12 is fixed at the center of a housing 11. Bearing members 16 are individually pushed into and fixed to an inner periphery of both ends of a pipe member 15 provided at the center of an armature 14 (a rotor) of a motor unit 13. These bearing members 16 are rotatably inserted over the fixed shaft 12 to rotatably support the pipe member 15 with the fixed shaft 12 through the bearing members 16. In this case, the bearing members 16 are pushed into and fixed to the inner periphery of the pipe member 15, thereby positioning the bearing members 16 between the pipe member 15 and the fixed shaft 12. An impeller 18 in a pump unit 17 is fitted and fixed to the pipe member 15, and the armature 14 of the motor unit 13, the pipe member 15, and the impeller 18 integrally rotate about the fixed shaft 12.

However, in the conventional construction described above, since the motor unit 13 and the pump unit 17 are arranged with a gap provided therebetween in the axial direction in the housing 11, the dimension of the fuel pump becomes large along its axial direction.

In the conventional construction described above, it is necessary to provide spaces for interposing the bearing members 16 between the pipe member 15 for supporting the armature 14 of the motor unit 13, and the fixed shaft 12. Accordingly, the outer diameter of the pipe member 15 increases, and storage space for the armature 14 decreases in the housing 11. As a result, space for armature windings decreases, motor output decreases, and discharge capability of the pump also decreases. On the other hand, when the outer diameter of the housing 11 is increased to secure the winding space of the armature 14, and to prevent decrease of the motor output and to prevent decrease of the discharge capability, the outer diameter of the fuel pump increases.

In the conventional construction described above, the outer peripheral surface of the bearing members 16 is pressed against the inner peripheral surface of the pipe member 15, and the inner peripheral surface of the bearing members 16 is slidably in contact with the outer peripheral surface of the fixed shaft 12. Because of this, precision in dimension and concentricity is required both for the inner diameter and the outer diameter of the bearing members 16. When the precision of the inner diameter and the outer diameter of the bearing members 16 decreases in dimension and concentricity, the assembly of the fuel pump becomes difficult. Additionally, the armature 14 may vibrate and noise may be generated when the fuel pump is in operation. Thus, it is necessary to precisely machine both the inner diameter and the outer diameter of the bearing members 16 to secure the precision of the inner diameter and the outer diameter in dimension and concentricity. As a result, the time and costs associated with machining the bearing members 16 may increase, and the overall manufacturing cost of the fuel pump may increase.

SUMMARY OF THE INVENTION

A first object of the present invention is to decrease the axial dimension of the fuel pump. A second object of the present invention is to reduce the diameter of the pipe member, which supports the armature of the motor unit, to increase the storage space for the armature in the housing, to increase the pump discharge capability, and to reduce the outer diameter of the fuel pump. A third object of the present invention is to simplify the machining of the bearing members while maintaining precision in dimension and concentricity required of the bearing members. Finally, reducing machining costs is desired.

In a first aspect of the invention, a fuel pump of the present invention includes a pump unit for drawing and discharging fuel, a motor unit for driving the pump unit, a housing for housing the pump unit and the motor unit, a fixed shaft fixed at the center of the housing, a pipe member provided at the center of an armature of the motor unit, and inserted over the fixed shaft, and bearing members individually used for rotatably supporting both ends of the pipe member on the fixed shaft. A part of said armature and a rotational body of the pump unit are arranged on the bearing members located on the side of the pump unit such that they are overlapped with each other to integrally rotate. With this construction, the storage space for the motor unit and the pump unit decreases in the axial direction in the housing, and the axial dimension of the fuel pump decreases.

In one regard, it is preferable to form the fuel pump such that the part of the armature overlapped with the rotational body of the pump unit is engaged with the rotational body to transmit a rotational force of the armature to the rotation body. With this construction, the engagement structure (a coupling structure) between the armature and the rotational body of the pump unit is compactly formed on the bearing member. In another regard, it is preferred that the part of the armature overlapped with the rotational body of the pump unit be made of a resin.

To attain the second object, in another aspect, the ends of the pipe member may be placed between the fixed shaft and the bearing members. With this construction, it is not necessary to provide spaces for interposing the bearing members between the pipe member and the fixed shaft, and the outer diameter of the pipe member can be reduced accordingly. As a result, the storage space for the armature in the housing can be increased, the winding space for the armature can be increased, and the motor output and the pump discharge capability can be increased. In other words, even when the outer diameter of the housing is made small, the winding space secured for the armature is almost as large as that in the conventional case. Additionally, the outer diameter of the fuel pump can be reduced while the discharge capability of the pump can be maintained at the conventional pump level.

To attain the third object, in another aspect, a through hole in a step shape may be formed at the center of the bearing members. Additionally, the fixed shaft may be rotatably inserted into a part of the through hole with a smaller diameter (referred to as a "small diameter hole"), and a part of the through hole with a larger diameter (referred to as a "large diameter hole") may support the ends of the pipe member. With this construction, since it is not necessary to provide spaces for interposing the bearing members between the pipe member and the fixed shaft, beneficial effects can be obtained.

Since the large diameter hole for supporting the pipe member and the small diameter hole for inserting over the fixed shaft are formed concentrically on the inner peripheral side of the bearing members, the inner peripheral side of the bearing member is machined using a cutting tool while the outer periphery of the bearing member is held by a chuck during machining of the bearing members. Thus, the large diameter hole for supporting the pipe member and the small diameter hole for inserting over the fixed shaft are precisely formed on the inner peripheral side of the bearing members while the shaft centers of both of the holes precisely coincide with each other. Consequently, machining the bearing members becomes simple while dimensional accuracy and precise concentricity required for the bearing members is secured. Additionally, machining costs decrease.

In this case, though an independent member may be interposed between the large diameter hole of the bearing members and the ends of the pipe member, it is preferable that the ends of the pipe member be pushed into and fixed to the large diameter hole of the bearing members. This construction makes the shaft center of the pipe member precisely coincide with the shaft center of the large diameter hole of the bearing member. Thus, the precision in concentricity among the pipe member, the bearing members, and the fixed shaft increases compared with the case where the independent member is interposed between the large diameter hole of the bearing members and the ends of the pipe member. Additionally, runout of the armature caused by the low concentricity (non-concentric condition) can be prevented.

In the structure for supporting the rotational body of the pump unit, though the rotational body of the pump unit may be inserted over the fixed shaft, sliding friction is generated between the fixed shaft and the rotational body. As a result, pump performance decreases accordingly, and the rotational body may be fused to the fixed shaft because of frictional heat when the rotational body is formed of a resin.

In consideration of this, a guide hole slightly larger than the outer diameter of the bearing member is formed at the center of the rotational body of the pump unit. The bearing member is fitted into the guide hole of the rotational body. Coupling protrusions provided on the armature of the motor unit are engaged with engagement parts formed on the rotational body. Thereby the rotational force of the armature is transmitted to the rotational body. With this construction, the rotational body of the pump unit rotates while the rotational body is guided by the outer peripheral surface of the bearing member which rotates integrally with the armature. Thus, the rotational friction of the rotational body decreases, the pump performance increases accordingly, and the fusion of the rotational body to the bearing member caused by frictional heat can be prevented even when the rotational body is made of a resin.

Additionally, a pump cover may constitute an end surface of the housing on the motor unit side, and a fixing hole for fixing the end of the fixed shaft may be formed on the pump cover. In addition, a tapered part may be formed on the side of the motor unit in the fixing hole. With this construction, the tapered part guides the end of the fixed shaft to the fixing hole on the pump cover when the end of the fixed shaft is inserted into, or pushed into, the fixing hole on the pump cover in a manufacturing and assembling process of the fuel pump. Thus, the operation for inserting or pushing the end of the fixed shaft into the fixing hole on the pump cover is facilitated.

Again, the pump cover may be made of a resin. With this construction, the requirement of reducing the manufacturing cost, and reducing part weight is satisfied. When the housing is made of a resin, the housing including the pump cover may be integrally formed with the resin.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE PREFERRED EMBODIMENTS

[First Embodiment]

Figure 1:
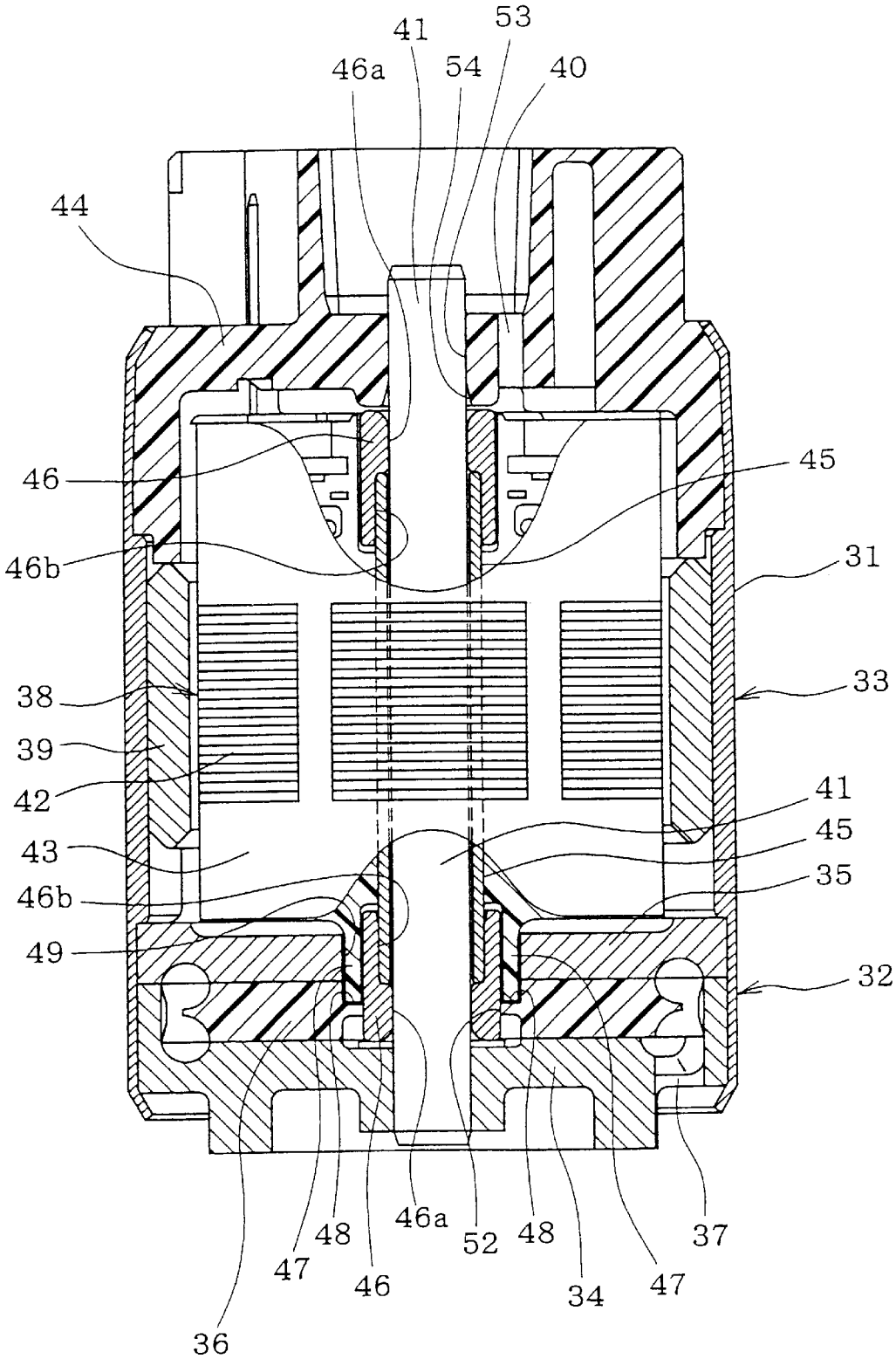
FIG. 1 is a vertical cross-sectional view of a fuel pump according to a first embodiment of the present invention.
Figure 2:
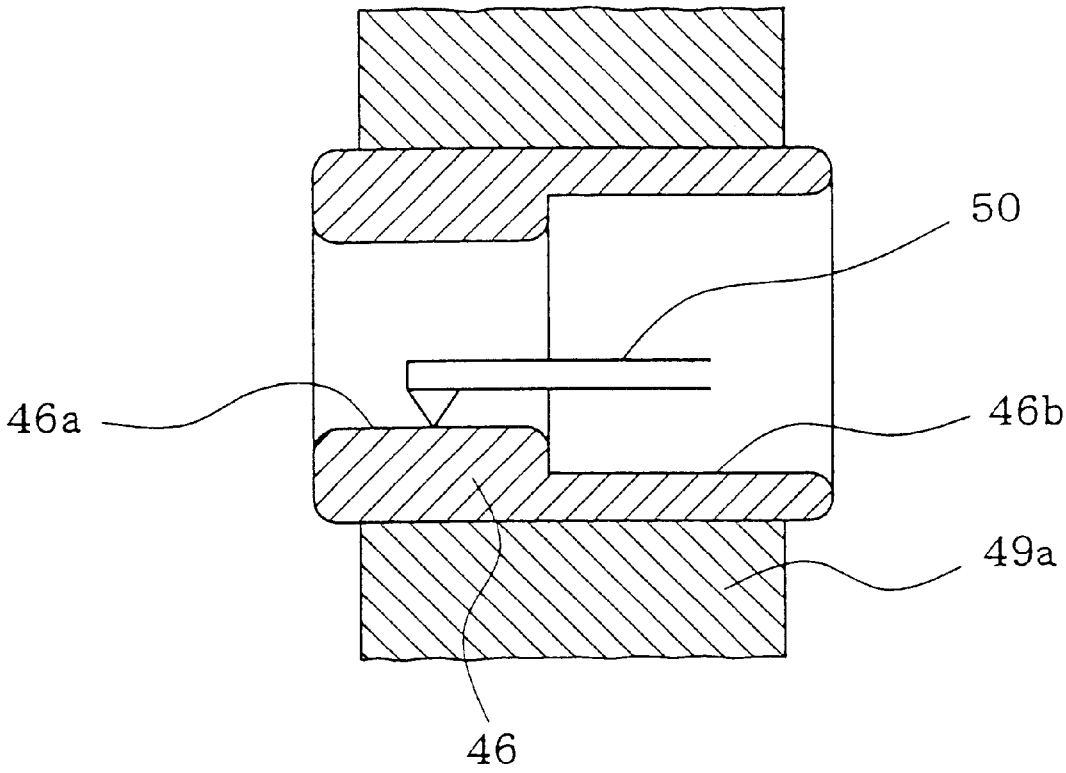
FIG. 2 is an enlarged cross-sectional view showing machining of a bearing member according to a first embodiment of the present invention.

The following describes a first embodiment of the present invention based on FIG. 1 and FIG. 2. The overall construction of a fuel pump will be outlined first. A pump unit 32 and a motor unit 33 are arranged in the axial direction, and are installed in a cylindrical housing 31 of the fuel pump. The pump unit 32 is constructed such that metal or resin pump casings 34 and 35 are fixed to a bottom end of the housing 31 by means of caulking or the like, and a resin or metal impeller 36 (a rotational body) is stored in the pump casings 34 and 35. A fuel suction (drawing) port 37 is formed on the lower pump casing 34. Fuel in a fuel tank (not shown) is drawn into the pump casings 34 and 35 through the fuel suction port 37. The fuel discharged from a discharge port (not shown) formed on the upper pump casing 35 is discharged from a fuel discharge port 40 after passing through a gap formed between an armature 38 and magnets 39 of the motor unit 33.

The magnets 39 arranged in a cylindrical shape on the outer periphery of the motor unit 33 are fixed to the inner peripheral surface of the housing 31. The armature 38 is concentrically placed inside the magnets 39. The armature 38 is constructed such that armature coils (not shown) are placed in slots of a core 42, and are molded with resin 43. The armature 38 is rotatably supported by a bearing structure, which is described later, on the fixed shaft 41 fixed at the center of the housing 31. The bottom end of the fixed shaft 41 is fixed to a hole at the center of the lower pump casing 34 by a press fit (pushing it on), and the top end of the fixed shaft 41 is fixed by means of a press fit (pushing it on) or adhesion to a fixing hole 53 at the center of a pump cover 44, which is fixed to the top end of the housing 31 by means of caulking.

In this case, the pump cover 44 is formed with resin, for example, and a tapered part 54 is formed on a portion (on the lower side) of the fixing hole 53 on the motor unit 33 side. When the end of the fixed shaft 41 is inserted or pushed into the fixing hole 53 in the pump cover 44 in a manufacturing and assembling process, the tapered part 54 serves to guide the end of the fixed shaft 41 to the fixing hole 53 on the pump cover 44. Thus, pushing or inserting the end of the fixed shaft 41 into the fixing hole 53 on the pump cover 44 is facilitated. When the housing 31 is formed with resin, the housing 31 including the pump cover 44 may be integrally formed with resin.

The following describes the bearing structure for allowing the fixed shaft 41 to rotatably support the armature 38. A metal pipe member 45 is pushed into and fixed to an inner periphery of the core 42 of the armature 38. The pipe member 45 is inserted over the fixed shaft 41. The inner diameter of the pipe member 45 is slightly larger than the outer diameter of the fixed shaft 41, and a slight gap is formed between the inner peripheral surface of the pipe member 45 and the outer peripheral surface of the fixed shaft 41. A through hole has a step comprising a small diameter hole 46*a* and a large diameter hole 46*b*, and is formed at the center of the bearing members 46 which support the pipe member 45 at both ends. The ends of the pipe member 45 are pushed into, and fixed to the large diameter hole 46*b* of the bearing members 46. A fixed shaft 41 is rotatably inserted into the small diameter holes 46*a*. Consequently, the armature 38 is rotatably supported by the fixed shaft 41. With this construction, the ends of the pipe member 45 exist between the fixed shaft 41 and the bearing members 46.

A circular guide hole 52 slightly larger than the outer diameter of the bearing member 46 is formed at the center of the impeller 36 of the pump unit 32, and the guide hole 52 is fitted to the bearing member 46. The impeller 36 rotates and is guided by the outer peripheral surface of the bearing member 46 which rotates integrally with the armature 38.

Multiple resin coupling protrusions 47 protrude toward the pump unit 32 on the bottom end (an end on the side of the pump unit 32) of the armature 38, and are integrally formed at an equal, or consistent, interval so as to surround the bearing member 46. Tips of the individual coupling protrusions 47 are inserted into, and engaged with engagement recesses 48 (the engagement parts) formed in the impeller 36. This coupling structure transmits a rotational force of the armature 38 to the impeller 36 through the coupling protrusions 47, and the impeller 36 is driven to rotate. A circular hole 49 is formed at the center of the upper pump casing 35 for the coupling protrusions 47 to freely rotate about the fixed shaft 41.

In this case, the coupling protrusions 47 are a part of the armature 38, and the part of the armature 38 (the coupling protrusions 47) and the impeller 36 are overlapped with each other, and integrally rotate on the bearing member 46 on the side of the pump unit 32.

In the fuel pump constructed as described above, when electric power is supplied to the motor unit 33, the armature 38 rotates. Then, the rotational force is transmitted to the impeller 36 through the coupling protrusions 47, and the impeller 36 is driven to rotate, thereby the fuel in the fuel tank (not shown) is drawn into the pump casings 34 and 35 through the fuel drawing (suction) port 37. The drawn fuel is discharged from the discharge port (not shown) formed on the upper pump casing 35 and is discharged from the fuel discharge port 40 after passing through the gap formed between the armature 38 and the magnets 39 of the motor unit 33.

In the bearing structure for the fuel pump according to the first embodiment described above, the through hole, which has the step comprising the small diameter hole 46*a* and the large diameter hole 46*b*, is formed at the center of the bearing members 46. The ends of the pipe member 45 are pushed into and fixed to the large diameter hole 46*b* of the bearing members 46. The fixed shaft 41 is rotatably inserted into the small diameter holes 46*a*. Consequently, the armature 38 is rotatably supported by the fixed shaft 41.

With the first embodiment, since the ends of the pipe member 45, which support the armature 38, are placed on the inner peripheral side of the bearing members 46, it is not necessary to provide spaces for interposing the bearing members 46 between the pipe member 45 and the fixed shaft 41, and the outer diameter of the pipe member 45 can be reduced accordingly. As a result, the storage space for the armature 38 in the housing 31 can be increased, the winding space for the armature 38 can be increased, and the motor output and the pump discharge capability can be increased. In other words, even when the outer diameter of the housing 31 is reduced by the amount corresponding to the reduction of the diameter of the pipe member 45, winding space for the armature 38, almost as large as that in the conventional case, can be secured. The outer diameter of the fuel pump can be reduced while maintaining a pump discharge capability almost as much as that in the conventional case.

With the first embodiment, a part of the armature 38 (the coupling protrusions 47) and the impeller 36 are overlapped with each other, and integrally rotate on the bearing member 46 on the side of the pump unit 32. Thus, the storage space for the motor unit 33 and the pump unit 32 can be reduced in the axial direction of the housing 31, and the dimension of the fuel pump can be reduced in the axial direction. Consequently, with the first embodiment, the outer diameter and the axial length of the fuel pump can be reduced.

With the first embodiment, the large diameter hole 46*b* for receiving the pipe member, and the small diameter hole 46*a* for inserting around (receiving) the fixed shaft may be formed concentrically on the inner peripheral side of the bearing members 46. Thus, by cutting the inner peripheral side of the bearing member 46 using a cutting tool 50 while the outer periphery of the bearing member 46 is held by a chuck 49*a* during machining of the bearing members 46 as shown in FIG. 2, the large diameter hole 46*b* for receiving the pipe member and the small diameter hole 46*a* for receiving the fixed shaft can be precisely formed on the inner peripheral side of the bearing members 46 while the shaft centers of both of the holes precisely coincide with each other. Consequently, machining of the bearing members 46 becomes simple while precision in dimension and concentricity required for the bearing members 46 is secured. As a result, the machining cost is decreased, and the requirement of decreasing cost is satisfied.

With the first embodiment, since the ends of the pipe member 45 are pushed into, and are fixed within the large diameter hole 46*b* of the bearing members 46, this makes the shaft center of the pipe member 45 precisely coincide with the shaft center of the large diameter hole 46*b* of the bearing members 46. Thus, the precision in concentricity among the pipe member 45, the bearing members 46, and the fixed shaft 41 increases compared with a case where independent members are interposed between the large diameter hole 46*b* of the bearing members 46 and the ends of the pipe member 45. This prevents runout of the armature 38 caused by inadequate concentricity.

With the first embodiment, since the circular guide hole 52, slightly larger than the outer diameter of the bearing member 46, is formed at the center of the impeller 36 of the pump unit 32 and the guide hole 52 of the impeller 36 is fitted to the bearing member 46, the impeller 36 can rotate while the impeller 36 is guided by the outer peripheral surface of the bearing member 46 which rotates integrally with the armature 38. As a result, the rotational friction of the impeller 36 decreases, and the pump performance increases accordingly. In addition, the fusion of the impeller 36 to the corresponding member (the bearing member 46) caused by frictional heat is prevented when the impeller 36 is formed with resin, thereby the reliability and the durability increase.

Since a slight gap is formed between the guide hole 52 of the impeller 36 and the outer periphery of the bearing member 46, a difference in coefficient of thermal expansion between the impeller 36 and the bearing member 46 can be absorbed by the gap between them, and a generation of a crack on the impeller 36 caused by thermal stress can be prevented. Since the impeller 36 freely slides in the axial direction with respect to the bearing member 46, when the positional relationship between the pump casings 34, 35 and the bearing member 46 changes, the impeller 36 can be moved in the axial direction according to the amount of the change to position the impeller 36 at the center between the pump casings 34, 35. Further, an increase of the slide friction between the impeller 36 and the pump casings 34, 35 caused by assembly error, and the like, can be prevented.

Figure 4:
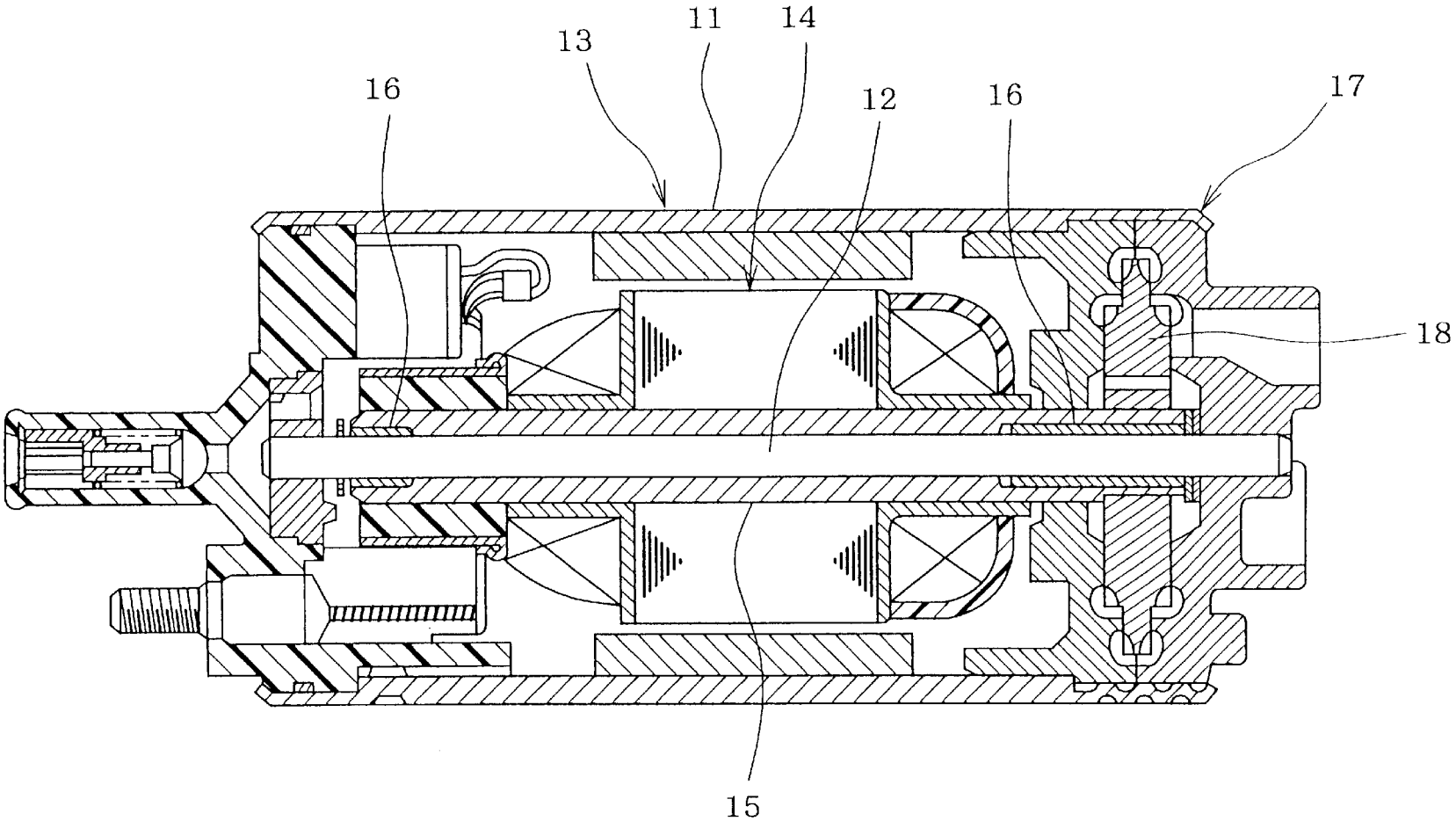
FIG. 4 PRIOR ART
FIG. 4 is a cross-sectional view of a conventional fuel pump.

In the conventional fuel pump shown in FIG. 4, engaging parts of the impeller 18 and the pipe member 15 are formed into a non-circular shape such as a D-shape to prevent them from slipping while rotating and to transmit the rotational force. With this construction, since the shaft centers of the impeller 18 and the pipe member 15 are displaced, or the center of gravity of the impeller 18 is displaced from the center of rotation (the shaft center of the pipe member 15), vibration and noise may occur due to runout of the impeller 18, or a fluctuation in the discharging pressure may occur.

On the other hand, in the first embodiment, the circular guide hole 52 formed at the center of the impeller 36 is fitted to and supported by the bearing member 46. By so doing, it is possible to make the shaft center of the impeller 36 precisely coincide with the shaft center of the bearing member 46, and the center of gravity of the impeller 36 coincide with the center of rotation (the shaft center of the pipe member 45). Consequently, vibration and noise can be reduced by a reduction in runout of the impeller 36. Additionally, fluctuations in the discharging pressure can be reduced.

While in the first embodiment, the coupling protrusions 47 are integrally formed with the armature 38 using a mold resin, coupling protrusions formed as parts independent to the armature 38 may be fixed to the armature 38 using insert molding. The coupling structure between the armature 38 and the impeller 36 may be changed. For example, a tubular coupling protrusion may be concentrically provided on the armature 38. An inner peripheral side of this tubular coupling protrusion may be inserted over the bearing member 46. Further, a cross-sectional shape of the tubular coupling protrusion may be formed as a non-circular shape such as a D-shape, and the tubular coupling protrusion may be inserted and engaged with a non-circular engagement hole formed at the center of the impeller 36.

[Second Embodiment]

Figure 3:
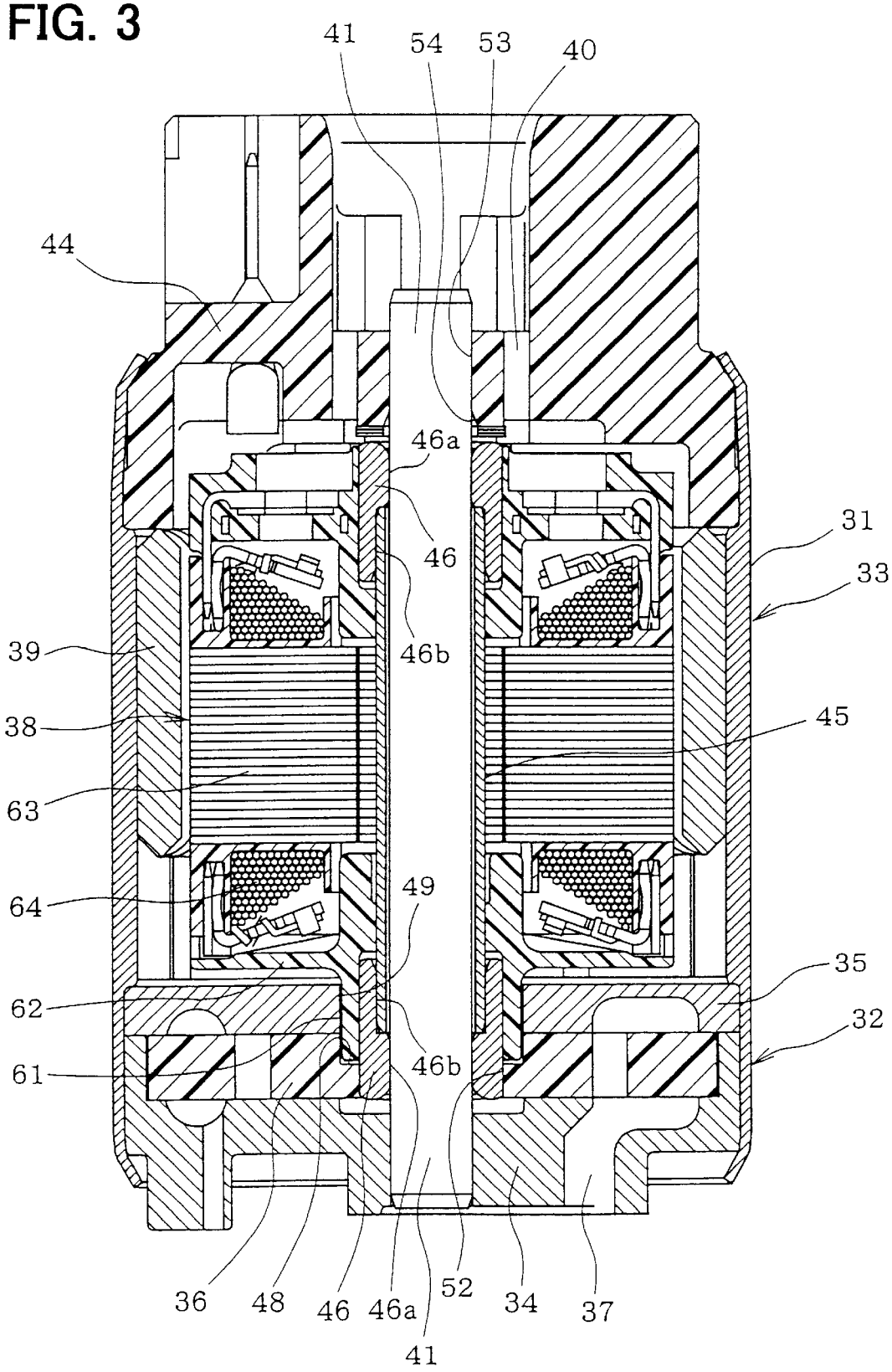
FIG. 3 is a vertical cross-sectional view of a fuel pump according to a second embodiment of the present invention.

While the coupling protrusions 47 are formed integrally with the armature 38 in the first embodiment, in a second embodiment of the present invention shown in FIG. 3, coupling protrusions 61 are formed on a tubular coupling member 62. The coupling member 62 is put on and attached to an end surface of the armature 38 to engage the coupling member 62 and the armature 38 for preventing slippage. The coupling protrusions 61 and the coupling member 62 are formed integrally with resin, for example. The armature 38 is assembled such that the armature core 63 is divided into multiple divided cores in the circumferential direction, windings 64 are wound on the multiple divided cores, and the divided cores are connected into a circular shape by engagement. The balance of the construction is essentially the same as that of the first embodiment. The same numerals are assigned to the same elements, and description of those elements, therefore, is not again provided.

The second embodiment constructed as described above provides effects similar to those of the first embodiment. In the first and second embodiments, though the pump unit 32 is constructed as a turbine pump, anther type of pump unit 32 may be used, such as a trochoid pump. Various types of modifications such as properly changing the support structure of the fixed shaft 41 can be applied to the present invention.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fuel pump comprising:

a pump unit for drawing and discharging fuel;

a motor unit for driving the pump unit;

a housing for containing the pump unit and the motor unit;

a stationary shaft fixed at the center of the housing;

a pipe member provided at the center of an armature of said motor unit and inserted over said fixed shaft; and bearing members individually used for rotatably supporting both ends of said pipe member on said fixed shaft, wherein ends of said pipe member are placed between said shaft and said bearing members.

2. A fuel pump comprising:

a pump unit for drawing and discharging fuel;

a motor unit for driving the pump unit;

a housing for containing the pump unit and the motor unit;

a stationary shaft fixed at the center of the housing;

a pipe member provided at the center of an armature of said motor, and inserted over said shaft; and bearing members individually used for rotatably supporting both ends of said pipe member on said fixed shaft, wherein a through hole with a step shape is formed at the center of said bearing members, said shaft is rotatably inserted into a part of said through hole with a smaller diameter, and a part of said through hole with a larger diameter supports the ends of said pipe member.

3. The fuel pump according to claim 2, wherein the ends of said pipe member are pressed into the larger diameter of said bearing members.

4. The fuel pump according to claim 2, wherein a guide hole slightly larger than the outer diameter of said bearing member is formed at the center of the rotational body of said pump unit, said bearing member is fitted into the guide hole of the rotational body, and coupling protrusions provided on the armature of said motor unit are engaged with engagement parts formed on said rotational body to transmit a rotational force of said armature to said rotational body.

5. The fuel pump according to claim 3, wherein a guide hole slightly larger than the outer diameter of said bearing member is formed at the center of the rotational body of said pump unit, said bearing member is fitted into the guide hole of the rotational body, and coupling protrusions provided on the armature of said motor unit are engaged with engagement parts formed on said rotational body to transmit a rotational force of said armature to said rotational body.

6. The fuel pump according to claim 5, wherein a pump cover, defining a fixing hole, constitutes an end surface of said housing on the motor unit side, said fixing hole fixes the end of said fixed shaft, and a tapered part is formed around said fixing hole on the motor unit side.

7. The fuel pump according to claim 6, wherein said pump cover is made of a resin.

* * * * *